United States Patent [19]

Larsson

[11] Patent Number: 4,583,561

[45] Date of Patent: Apr. 22, 1986

[54] HAIR TWINING APPARATUS

[75] Inventor: Ake L. Larsson, Palos Verdes Estates, Calif.

[73] Assignee: Mattel, Inc., Hawthorne, Calif.

[21] Appl. No.: 541,812

[22] Filed: Oct. 13, 1983

[51] Int. Cl.[4] ..... A45D 1/00

[52] U.S. Cl. ..... 132/9

[58] Field of Search ..... 132/9, 5, 7, 33 C, 34 R, 132/38 A; 87/33, 8, 13, 62

[56] References Cited

U.S. PATENT DOCUMENTS 4,038,996 8/1977 Eronini ..... 132/9

4,369,690 1/1983 Sapkus ..... 132/9 X

*Primary Examiner*—Gregory E. McNeill

*Attorney, Agent, or Firm*—Ronald M. Goldman; Melvin A. Klein; Daniel F. Sullivan

[57] ABSTRACT

A hair twining apparatus configured for one hand operation of a trigger, the apparatus having at least two hair clamp members carried by a sub-housing within a housing. With a switch in a first position, pumping of the trigger rotates the clamp members about the supporting shafts thereof for twisting groups of hair filaments attached to the clamp members. With the switch in a second position, pumping of the trigger causes intermittent unidirectional angular displacement of the hair clamp members to twine the strands by rotating the sub-housing.

4 Claims, 7 Drawing Figures

HAIR TWINING APPARATUS

DESCRIPTION

1. Technical Field

This invention relates to hair twining apparatus, and more particularly to hand operated hair twining apparatus for use with human or synthetic hair.

2. Cross-Reference to Related Application

The subject matter of this application is related to the subject matter of U.S. patent Application Ser. No. 475,007, filed Mar. 14, 1983 by Frederic A. Schwager and Mark S. Wittenberg for "Hair Twining Apparatus", and assigned to Mattel, Inc., the assignee of the instant application.

BACKGROUND ART

Braiding machines have been used extensively in the textile industry. Such braiding machines are shown and described, for example, in U.S. Pat. Nos. 352,804; issued Nov. 16, 1886 to Bowerson; 433,855, issued Aug. 5, 1890 to Ellis; 830,137 issued Sept. 4, 1906 to Diss; 1,398,444, issued Nov. 29, 1921 to Pfrunder; Re. 15,909, issued Sept. 2, 1924 to Pfrunder; 1,900,310, issued Mar. 7, 1933 to Somerville; 2,254,895, issued Sept. 2, 1941 to Johnston, Jr,; 2,782,590, issued Feb. 26, 1957 to Lowe; 2,878, 514, issued Mar. 24, 1959 to Nichols et al; 3,360,915, issued Jan. 2, 1968 to Franzen; 3,421,406, issued Jan. 14, 1969 to Mitchell et al; 3,439,486, issued Apr. 22, 1969 to Klein; 3,552,693, issued Jan. 5, 1971 to Scherf; 3,834,146, issued Sept. 10, 1974 to Nessler, et al; and 4,262,479, issued Apr. 21, 1981 to Lenorak. Another similar type of device intended for use with wire is shown and described in U.S. Pat. No. 359,409, issued Mar. 15, 1887 to Stone.

Such prior art braiding machines for use in creating yarn, for example, are simply twisting machines. Other such devices for use in forming rope or cord ordinarily employ means for simply interweaving two strands. Other such devices for use in the textile industry tend to be complicated apparatus, part of an overall machine, with complex mechanisms.

A braiding machine intended specifically for hair is shown and described in U.S. Pat. No. 4,038,996, issued Aug. 2, 1977, to Eronini, et al. The hair braider apparatus of that patent is a portable hair braider which is motor operated, and uses a plurality of foot members for hair parters to divide the hair over a predetermined width of the scalp, with hair grabbers then clamping the hair thus-parted and rotating the strands for weaving them together to form a braid.

Another braiding machine intended for use with hair is shown and described in U.S. Pat. No. 4,307,737, issued Dec. 29, 1981 to Shipman. In the apparatus of this patent, three strands of hair are drawn through three elongated tubes mounted for movement within an elongated cylindrical housing, having an operating lever extending out through a slot in the surface thereof. The tubes are intermittently alternated by the operator, a pair at a time, by means of guide members positioned within a central opening. The three tubes are movable along a track passing through the guide members for alternately selecting a pair of tubes for rotation.

Other braiding apparatus intended for use with hair is shown and described in U.S. Pat. No. 4,369,690, issued Jan. 25, 1983 to Sapkus, and assigned to Mattel, Inc., the assignee of the instant invention. The apparatus disclosed is a hand held, hand operated device having a plurality of aligned gear members, each having an aperture therethrough for passage therethrough of a plurality of hair filaments with a first pair of adjacent gear members having the positions interchanged in response to actuation of a lever member in a first direction with the remaining gear member then being interchanged with the adjacent one in response to pivoting of the lever member in the reverse direction.

DISCLOSURE OF THE INVENTION

The present invention is an improvement of the above-mentioned U.S. Patent Application of Frederic A. Schwager and Mark S. Wittenberg, Ser. No. 475,007 and employs a unique, compact gear mechanism to facilitate one hand operation. In the apparatus of the Schwager et al. application, a housing is provided intermediate the operator's handle and a pair of hair-clamping members. When the housing is restrained, actuation of the lever twists hair filaments into strands. When the housing is released, the strands are interweaved into twines. The housing is restrained by suitable ratchet and gear mechanisms within the housing.

The apparatus of the present invention includes first and second clamp members coupled to shafts having orbital gears at the ends thereof, the orbital gears being assembled for selective rotation by a main drive gear, these three gears being mounted in a sub-housing member. Lateral movement of a switch provides axial displacement of an integral carrier member to a first position enabling rotation of the shafts and clamp members to twist a plurality of hair filaments into individual strands of hair, and to a second position enabling the interchanging of the positions of the shafts and clamp members to intertwine the strands.

It is an object of the invention to provide a new and improved manually operable hair twining or braiding apparatus.

It is another object of the invention to provide a new and improved hair twining apparatus configured for operation with one hand to twist individual filaments of hair into strands and then intertwine the strands.

The objects, features and advantages of the invention will be better understood with reference to the following description, when taken in conjunction with the drawings in which like reference numerals refer to like elements in the several views.

BEST MODE FOR CARRYING OUT THE INVENTION

Figure 1:
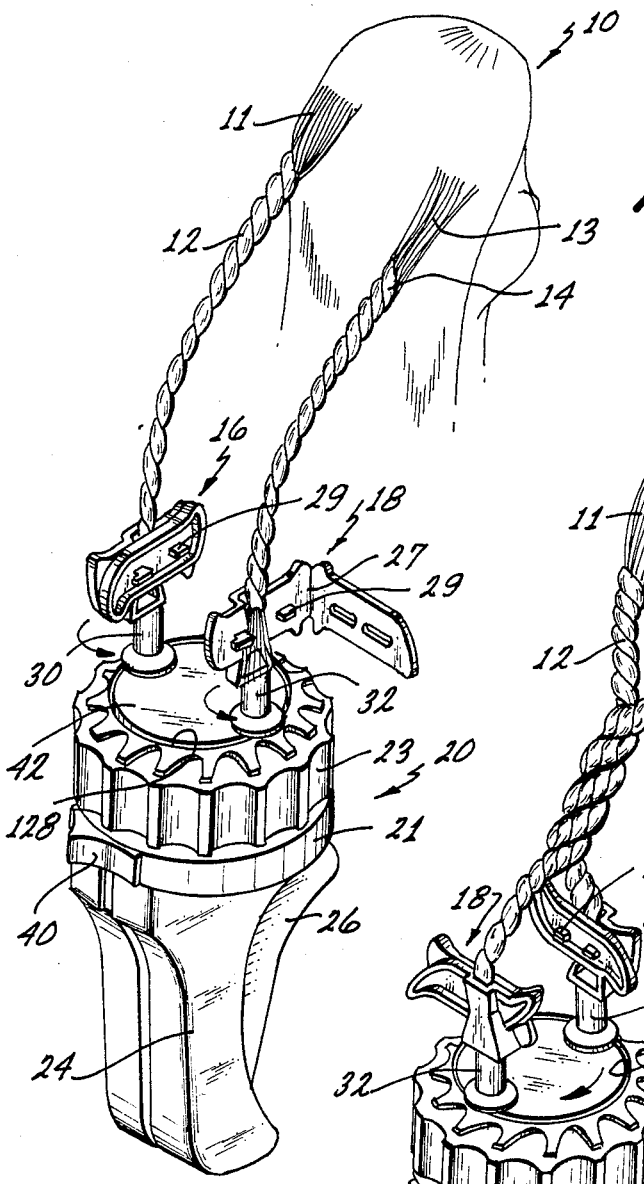
FIG. 1 is a perspective view of the hair twining or braiding apparatus of the invention illustrating the operation thereof while twisting hair filaments into strands.
Figure 2:
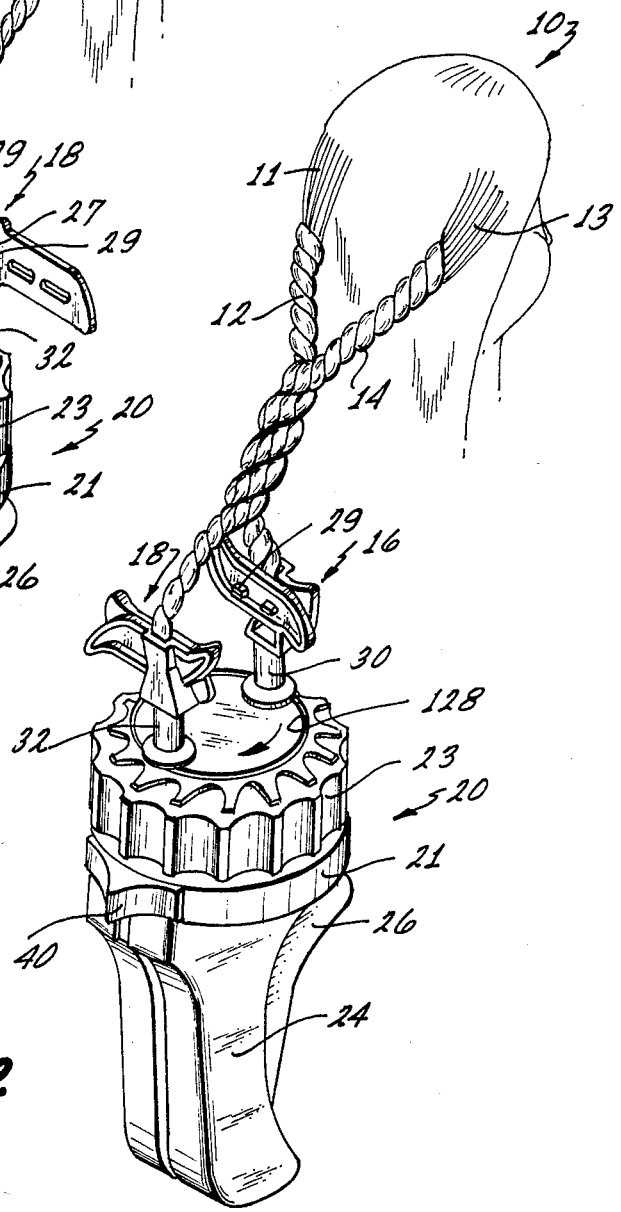
FIG. 2 is a perspective view similar to FIG. 1 depicting the operation of the apparatus intertwining the strands.

Referring now to the drawings, and particularly to FIGS. 1 and 2, there is shown a head 10 of a human or doll, with first and second groups of filaments 11 and 13 of hair received within first and second clamp members 16 and 18, respectively, of the hair twining apparatus, generally designated by the reference numeral 20.

The hair twining apparatus 20 is configured for being hand held and hand operated, with the apparatus including a main housing 22 having a handle portion 24, pivotally receiving therein an actuating member, or trigger 26 positioned for actuation by the hand of an operator against the force of a spring 28 (see also FIG. 3) abutting against the interior of the handle portion 24 while urging against the trigger 26.

Prior to a detailed description of the hair braiding apparatus 20, a description of the operation will be provided with reference to FIGS. 1 and 2. Structurally, the hair clamp members 16 and 18 are each formed as unitary plastic members having an integral hinge portion 27 and snap lock members 29 similar to conventional low cost barettes. The clamp members 16 and 18 are molded to the upper ends of first and second generally parallel shaft projections 30 and 32 which are coupled to orbintal gear members 34 and 36, respecitvely, (see FIG. 3) received within housing 22. As will be described later in detail, the clamp members 16 and 18, along with shaft projections 30 and 32 are adapted for rotation relative to each other and relative to the housing 22. To effect the different rotations utilized, a switch 40 is positioned above the rear surface of the handle portion 24 of the housing 22 for ready actuation with the thumb of the hand of the operator, the switch being movable left to right as viewed in FIGS. 1 and 2, to a first or second position.

With the switch 40 in a first position to the left in FIG. 1, and with the filaments 11, 13 received and retained in clamp members 16 and 18, respectively, pumping or repeated depression of the trigger 26 rotates both shaft projections 30 and 32 simultaneously in counterclockwise directions, as indicated by the arrows thereabout, to form strands 12, 14. During this operation, the shaft projections remain in fixed alignment relative to the housing 22, and the strands 12 and 14 of hair are twisted without intertwining.

When the switch 40 is moved to the right as illustrated in FIG. 2, and the trigger 26 is repeatedly pumped or actuated, the shaft projections 30 and 32 have the physical positions thereof relative to the housing continually displaced in a clockwise direction as indicated by the arrow on the disc member 42 which rotates during this operation carrying with it the shaft projections 30 and 32.

Briefly, in use, the operator affixes a plurality of filaments of hair to each of the clamp members 16 and 18, and with the switch 40 in the leftmost position of FIG. 1, actuates the trigger 26 until the desired twist of each strand 12, 14 is achieved, and then with the thumb the operator moves the switch 40 to the opposite position, repeats the actuation of the trigger 26 until the desired twine is achieved, at which point the clamp members 16 and 18 are released and a barette or ribbon is applied to secure the twine.

Figure 3:
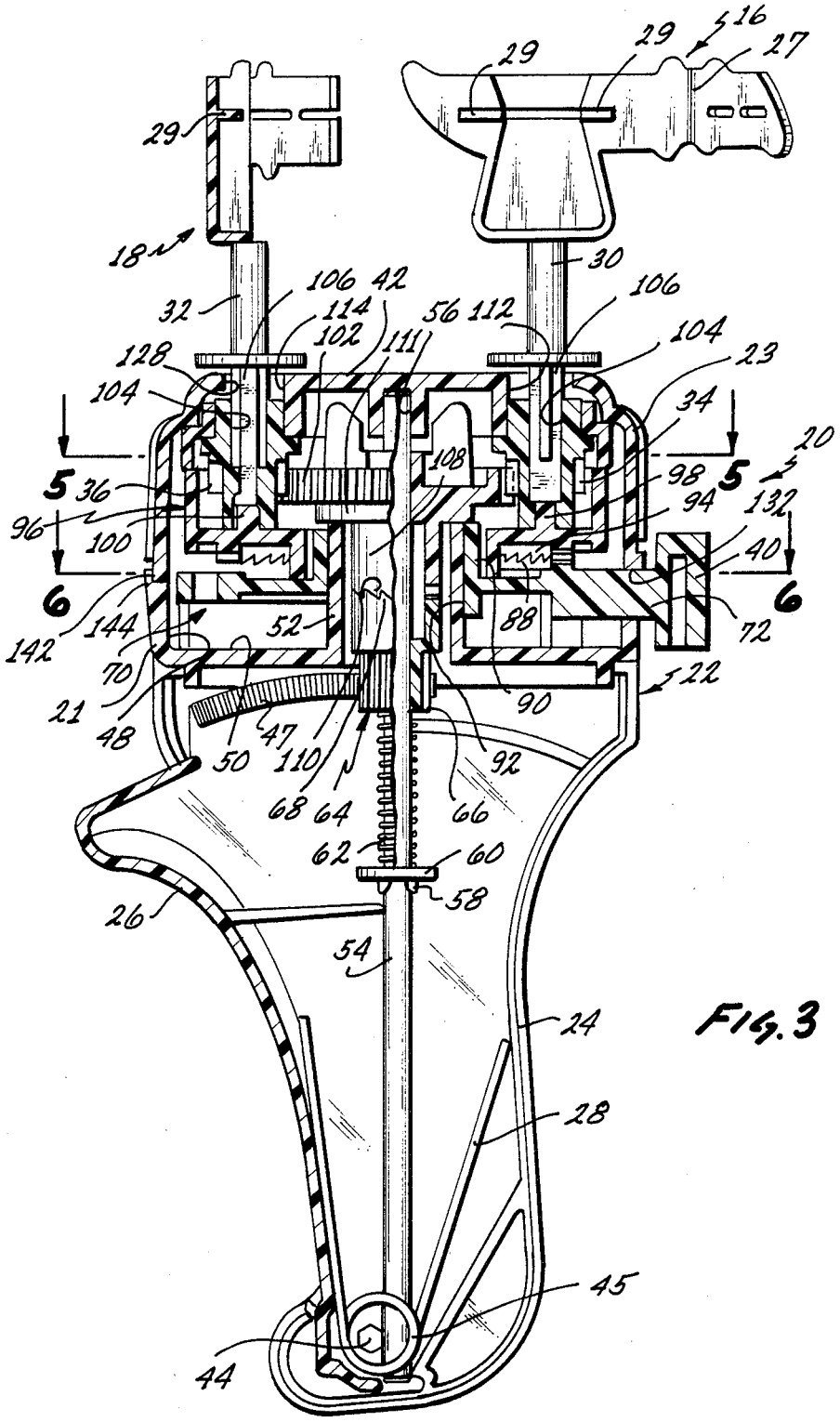
FIG. 3 is an enlarged plan view of the hair braiding or twining apparatus of FIG. 2, partially in cross-section, and partially broken away.
Figure 6:
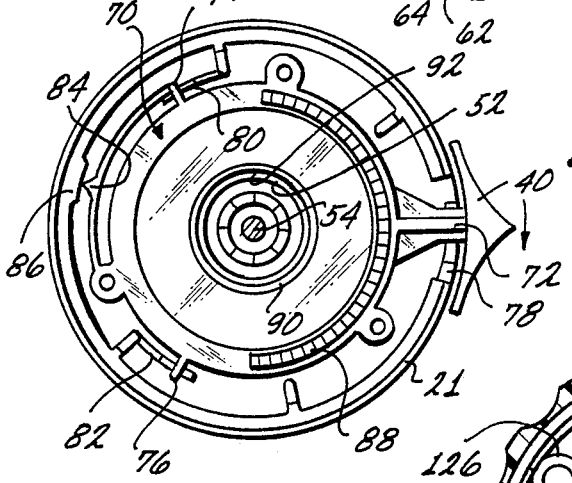
FIG. 6 is a cross-sectional view of the apparatus of FIG. 3, as viewed generally along line 6—6 thereof.
Figure 7:
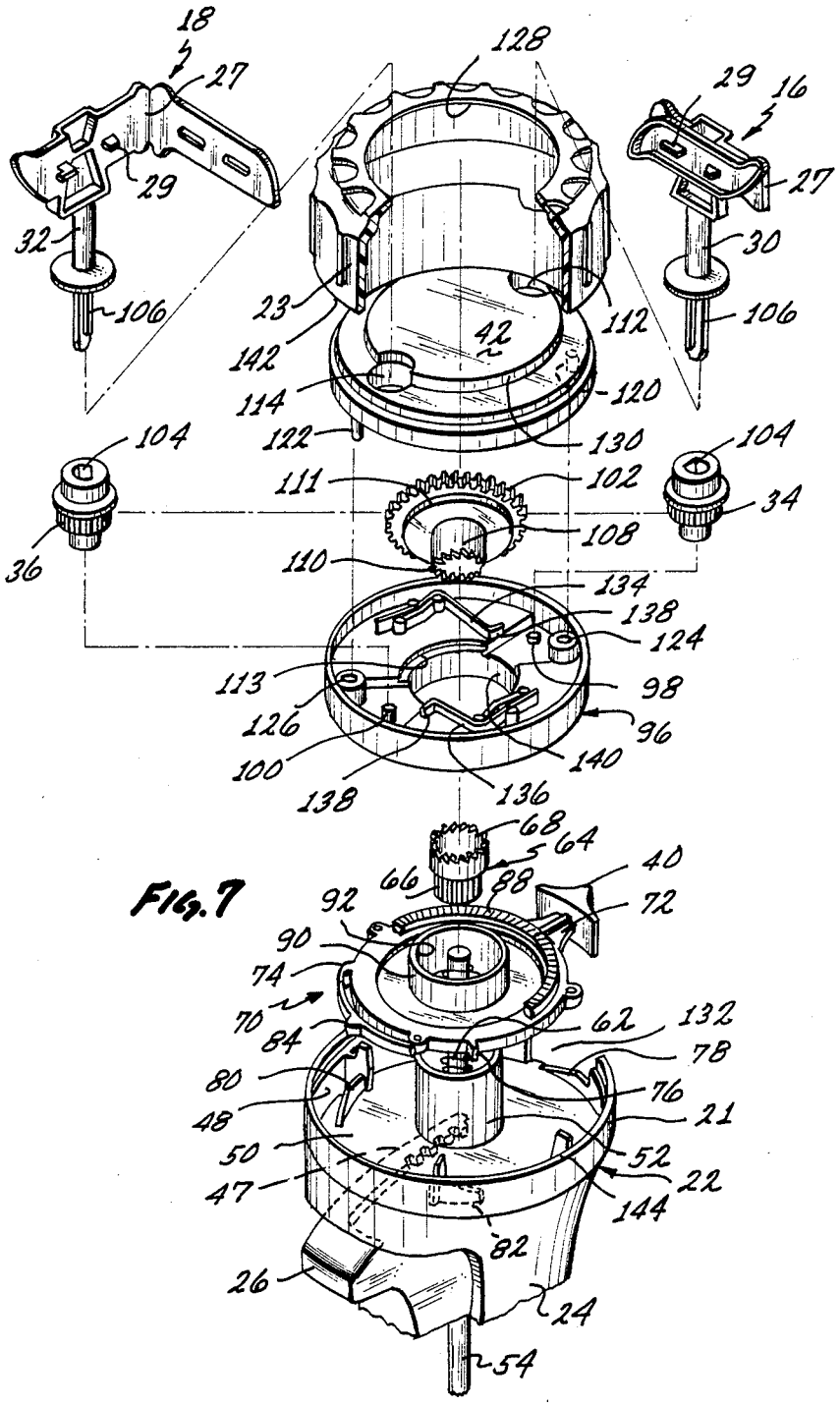
FIG. 7 is an exploded perspective view of the mechanism of the apparatus of FIG. 1, partially in cross-section and partially broken away, with the drive gear member thereof partially rotated to illustrate details thereof.

Referring now to FIGS. 3–7, and particularly to FIGS. 3 and 7, the details pertaining to the construction of the apparatus 20 will be described. The housing 22 includes the hollow handle portion 24, an intermediate housing portion 21, and an upper housing portion 23. Although not clearly shown, as is common in plastic assembly, the handle portion 24 would ordinarily be formed of two parts which would then be secured together to form the hollow handle portion 24.

As illustrated in FIG. 3, the trigger 26 is mounted within the handle portion 24 for pivoting about a pivot 44 which is also encircled by the coil portion 45 of the spring member 28, which has one leg thereof abutting against the interior of the trigger 26 and the other leg thereof urging against the interior of handle portion 24. The upper end of trigger 26 has integrally formed therewith an arcuate rack member 47. The upper end of the handle portion 24 is generally closed by the intermediate housing portion 21, which is generally cup-shaped with a circular peripheral wall surface 48 and a bottom disc surface 50. Extending upwardly from the disc surface 50 is a generally centrally disposed cylindrical sleeve portion 52.

Mounted within the housing 22 is a shaft 54 which has one end thereof resting in the bottom of the handle portion 24, the shaft 54 extending through the sleeve portion 52 and being held captive at the other end thereof within a recess 56 formed in the undersurface of the disc surface 42, the shaft 54 essentially being the axis of rotation of several of the parts to be hereinafter described. As shown in FIG. 3, the shaft 54 is crimped at 58 to form a shoulder within the handle portion 24 with a washer 60 assembled on the shaft 54 for limiting movement of one end of a coil spring 62 encircling the shaft 54. Assembled on the shaft 54 thereafter is a pinion gear member 64, freely rotatable thereon with the lower surface of the pinion gear member 64 urging against the upper end of the coil spring 62. The pinion gear member 64 has a pinion gear portion 66 formed about the lower periphery thereof and a ratchet portion 68 formed in the upper edge thereof, the member 64 being dimensioned for insertion within the sleeve portion 52 of the intermediate housing portion 21 and rotatable therein.

The rack portion 47 of trigger 26 engages the pinion portion 66 of the pinion gear member 64 resulting in oscillatory motion of member 64 during repeated pumping of the trigger 26. Positionable within the intermediate housing portion 21 is a carrier member 70, pivotable through a limited angle by means of the switch 40, the carrier member 70 being generally annular.

The carrier member 70 has three equiangular projections 72, 74 and 76 for coacting with equiangularly disposed cams or ramps 78, 80 and 82 (FIGS. 6 and 7) formed within the intermediate housing 21. Pivoting of the carrier member 70 then raises or lowers the member 70. The projection 72 has the switch 40 secured thereto in a manner accessible to the operator. The carrier member 70, in addition, is provided with a spring detent 84 for coacting with a protrustion 86 (see FIG. 6) for locking the carrier member 70 to the left or right.

The carrier member 70 also has a gear sector or ratchet 88 and a centrally disposed tubular portion 90, having a central aperture 92 extending through it, integrally formed on the upper surface of carrier member 70. The diameter of aperture 92 is greater than the diameter of sleeve portion 52 of the intermediate housing portion 21 for passage therein on a non-interference basis.

Figure 4:
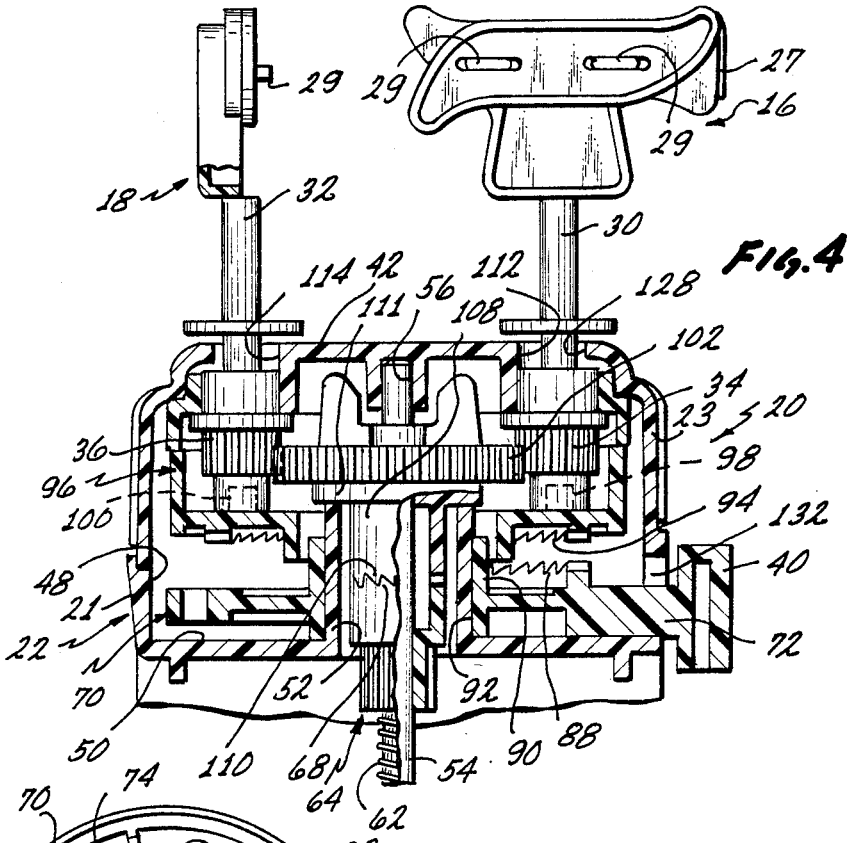
FIG. 4 is a partial plan view of the upper portion of the mechanism illustrated in FIG. 3, with the operative parts thereof shown in the alternate position.

Referring to FIGS. 3, 4 and 7, the gear sector 88 engages a ring gear or ratchet 94 on a sub-housing 96, which has secured thereto the disc member 42, for maintaining the sub-housing 96 along with disc member 42 stationary, when carrier member 70 is in its upper position, as shown in FIG. 3.

In the upper surface of the sub-housing 96, integrally formed upwardly extending diametrically opposed stub shafts 98 and 100 rotatably receive thereon the orbital gear members 34 and 36 which have pinion gear surfaces about the mid-portions thereof (see FIGS. 4 and 7) for coacting with the teeth of a main drive gear member 102. Orbital gear members 34 and 36 are provided with noncircular apertures 104 (FIG. 7) at the upper ends for receiving therein matingly configured ends 106 of the shaft projections 30 and 32.

In FIG. 7, the main drive gear member 102 has been slightly rotated to illustrate the configuration of the underside thereof with a downwardly depending central sleeve portion 108 having the lower edge 110 thereof in the form of a ratchet edge. Formed in the lower surface of the member 102 is a circular shoulder 111 positionable in a circular recess 113 provided in sub-housing 96. The diameter of the ratchet edge 110 is equal to the diameter of the ratchet edge 68 of the pinion gear member 64 with which it coacts. The disc member 42 is provided with diametrically opposed aligned openings 112 and 114 through which pass the shaft ends 106. The shaft projections 30 and 32 are molded integrally with washer members for providing lateral stability. The disc member 42 has depending projections 120 and 122 for being received within sleeves 124 and 126, respectively, on sub-housing 96. Consequently, the disc member 42 will rotate concurrently with the sub-housing 96 and may be considered a part thereof.

Figure 5:
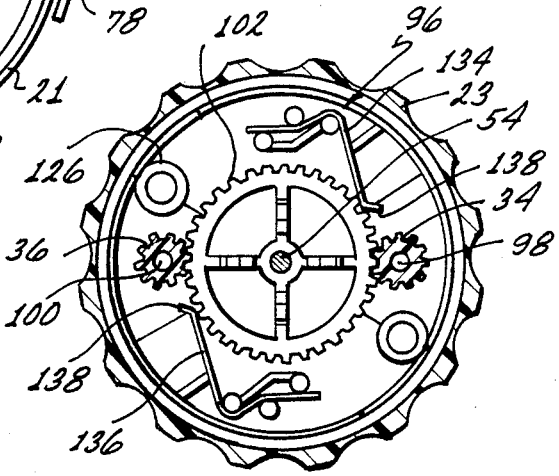
FIG. 5 is a cross-sectional view of the apparatus of FIG. 3 as viewed generally along line 5—5 thereof.

By reference to FIGS. 5 and 7, the upper housing portion 23 is of an inverted generally cup-shaped configuration with an enlarged central aperture 128 of a diameter slightly larger than the diameter of the circular shoulder 130 (FIG. 7) of the domed center portion of disc member 42.

Having described the parts, the assembly of the apparatus will now be described with reference to FIG. 7, particularly, and also with reference to FIGS. 3 and 5. Initially, the trigger 26 is assembled within handle portion 24 and the spring 28 is attached as shown in FIG. 3. The washer 60 is positioned on the shaft 54, followed by the coil spring 62 and then the intermediate housing portion 21 is secured to the handle portion 24 of the housing 22 as shown in FIG. 7. The carrier member 70 is next assembled by positioning the aperture 92 for passage over the shaft 54 with the equiangular projection 72 extending through an opening 132 adjacent cam 78 of the intermediate housing portion 21 and the projections 74 and 76 resting atop the cams 80 and 82, respectively. The pinion gear member 64 is then inserted over the shaft 54 passing through the aperture 92 until resting on the upper end of spring 62.

The sub-housing 96 may then have a pair of leaf springs 134 and 136 suitably secured thereto with the bent ends 138 thereof extending to a position adjacent recess 113. Next, the orbital gear members 34 and 36 are positioned on bearings or stub shafts 98 and 100. The drive gear member 60 is then positioned with the sleeve portion 108 thereof passing through an aperture 140 provided in the sub-housing 96. At this point, by reference to FIG. 5, it can be seen that the inner bent ends 138 of leaf springs 134 and 136 will detent within the teeth of the drive gear portion of the main drive gear 102. The disc member 42 is then suitably secured to the sub-housing 96 to close the same, and the sub-housing assembly is then placed atop carrier member 70 with tubular portion 90 of carrier member 70 positioned within the aperture 140 in the sub-housing 96. As the sub-housing 96 is urged into engagement, the upper end of shaft 54 will engage the recess 56 formed centrally in the under surface of disc or cover member 42. The upper housing portion 23 is then positioned over this and the skirt portion 142 thereof is suitably bonded to the inner peripheral wall portion 144 of the intermediate housing portion 21. The lower ends 106 of shaft projections 30, 32 are then inserted into and secured within the apertures 104 of the orbital gear members 34 and 36.

Prior to a detailed discussion of the operation and interaction of the various parts, the configuration and interaction of certain parts will be emphasized to enable a better understanding of the operation.

The ratchet mechanism formed by the coacting ratchet edge 68 of the pinion gear member 64 with the ratchet edge 110 of the drive gear member 102 is intended to favor rotation in the clockwise direction, and the inclination of the ratchet teeth is so configured. The inwardly extending bent ends 138 of the leaf spring members 134 and 136 coacting with the teeth of the drive gear 102 provides needed resistance to the unwinding force exerted by strands 12, 14 between pumping strokes on trigger 26. The interaction of gear sector 88 and ring gear 94 when carrier member 70 is in its uppermost position maintains sub-housing 96 and disc member 42 stationary. With this brief description of the ratchet means and the resistance means, a detailed description of the operation will now commence.

Initially, by reference to FIG. 3, the carrier member 70 is in its uppermost position corresponding to the switch 40 being to the left as viewed in FIG. 1, or pivoted fully counterclockwise, as viewed in FIG. 6. Conversely, by reference to FIG. 4, the carrier member 70 is in its lowermost position corresponding to the switch 40 being in the right, as viewed in FIG. 2, or pivoted fully clockwise, as viewed in FIG. 6.

With reference to FIGS. 1, 3, 5, 6, and 7, the operation will be described in the first mode, that is with the filaments 11, 13 of hair coupled to the clamp members 16 and 18 for twisting. With the switch 40 to the left as shown in FIG. 1, as previously described, the shaft projections 30 and 32 will remain in the position illustrated, and pumping or actuation of the trigger 26 will cause the shaft projections 30 and 32 to rotate, each about its own axis, thus causing rotation of the clamp members 16 and 18, respectively, in a counterclockwise direction. In this mode, the disc surface member 42 is fixed relative to the housing 22 of the apparatus 20.

With switch 40 to the left, the parts will be in the positions illustrated in FIG. 3, that is the carrier member 70 will be in its uppermost position along with the gear sector 88 carried thereby. In this position, the gear sector 88 will be in locking engagement with the ring gear 94, thus locking sub-housing assembly 96 relative to intermediate housing 21. The ratchet teeth 68 of pinion gear member 64 are engaged with ratchet teeth 110 of main drive gear member 102.

Upon depression of trigger 26, the pinion gear 64 will rotate in a clockwise direction, as viewed from the top of the apparatus 20. The ratchet means formed by ratchet teeth 68 of pinion gear 64 and ratchet teeth 110 of drive gear member 102 in engagement causes concurrent rotation of drive gear member 102 with concurrent simultaneous rotation of the orbital gears 34 and 36 in the opposite, or counterclockwise direction resulting. During this movement, the sub-housing 96 remains stationary due to the interlocking engagement of gear sector 88 and ring gear 94. As the trigger 26 returns to its original position under force of the spring 28, by reference to FIG. 5, the teeth of the drive gear member 102 have friction applied thereto by means of the inner bent ends 138 of the leaf springs 134 and 136. Simultaneously, the pinion gear member 68 is being urged into engagement with the drive gear member 102 under force of the coil spring 62. However, the ratchet teeth 68 and 110 are inclined for positive force in the clockwise direction with the relative forces of leaf springs 134 and 136 being greater than the axial force of the coil spring 62, thereby enabling separation of the ratchet mechanism during this reverse movement of trigger 26, resulting in no rotation of the drive gear member 102 or the orbital gears 34 and 36. On the next depression and release of the trigger 26, the operation is repeated with subsequent actuations creating a twisting of the filaments 11, 13 into strands 12 and 14, respectively.

After the desired amount of twist is achieved by the operator, the switch 40 is then moved to the right, as viewed in FIG. 2, and the parts are then in the position depicted in FIG. 4, which would correspond to the switch 40 actuation to the position shown in FIG. 5. In this position, the carrier member 70 is displaced downwardly due to the interaction of the projections 72, 74 and 76 with the ramps or cammed edges 78, 80 and 82 within the intermediate housing portion 21. As shown in FIG. 4, the coupling member 70 will be axially displaced downwardly toward the surface of the intermediate housing portion 21, with the gears 88 and 94 disengaged to enable selective rotation of sub-housing 96. It is also to be noted that the ratchet means between the pinion gear member 64 and the drive gear member 102 are in engagement due to the meshing of ratchet teeth 68 with ratchet teeth 110.

In this mode, as the trigger 26 is depressed inwardly against the force of the spring 28, the pinion gear member 64 is rotated in a clockwise direction as viewed from above. This force will be transmitted to the drive gear member 102 causing it to turn in the same direction, that is, clockwise. If tension is then applied to strands 12, 14, the sub-housing 96 will rotate disc member 42 in the direction of the arrow illustrated thereon in FIG. 2, that is, clockwise as depicted in FIG. 2. During this rotation, the tension on strands 12, 14 prevent the orbital gears 34 and 36 from rotating and the positions of the clamping members 16 and 18 will be effectively interchanged through an angle of 180° during this single depression of trigger 26.

As the trigger 26 is released to return to normal under force of the spring 28, the inner bent ends 130 of leaf springs 134 and 136 urging against the teeth of drive gear member 102 tend to apply friction to resist reverse rotation. This friction results in separation of the ratchet means between pinion gear member 64 and drive gear member 102, that is the ratchet teeth 68 rotate while the ratchet toothed edge 110 remains in position.

Upon subsequent actuations of trigger 26, the clamp members 16 and 18 are displaced 180° upon depression and remain stationary during return of the trigger 26. This results in the strands 12, 14 intertwined in a constant clockwise direction as depicted in FIG. 2.

While there are similarities in the twining apparatus of the instant application as contrasted to the aforementioned application Ser. No. 475,007, the novel construction heretofore described enables simplicity of construction by eliminating a number of parts. While there has been shown and described a preferred embodiment, it is to be understood that various other adaptations and modifications may be made within the spirit and scope of the invention.

I claim:

1. In a hair twining apparatus, the combination comprising:

a housing including a grippable hollow handle portion having a lower end and an upper end, an intermediate housing portion mounted to said upper end of said handle portion and an upper housing portion mounted to said intermediate housing portion, said upper housing portion having an open top;

a spring-biased trigger having a lower end and an upper end, said upper end being provided with an arcuate rack, said lower end being pivotally mounted to the lower end of said handle with said arcuate rack extending into said handle subjacent said intermediate housing portion;

a pinion gear member rotatably mounted in said intermediate housing portion, said pinion gear member including a pinion gear portion meshing with said arcuate rack for oscillation thereby when said trigger is actuated;

a sub-housing within said housing;

a drive gear member rotatably mounted in said sub-housing;

ratchet means for operably coupling said pinion gear member to said drive gear member;

first and second orbital gear members rotatably mounted within said sub-housing in meshing relation with said drive gear member;

first and second hair clamp means mounted on said sub-housing, each of said hair clamp means being mounted for concurrent rotation with one of said orbital gear members and being configured for gripping a plurality of hair filaments; and coupling means within said housing for selectively operating said hair twining apparatus in first and second positions, said coupling means in said first position locking said sub-housing relative to said housing and in said second position, said coupling means freeing said sub-housing for rotation, said ratchet means interconnecting said pinion gear member and said drive gear member and said orbital gear members along with said clamp means in a unidirectional manner with said coupling means in said first position during actuation of said trigger with the locking of said sub-housing to said housing restaining said sub-housing from rotation to thereby twist the hair filaments into strands, said coupling means including (a) a ring gear mounted on said sub-housing, (b) a carrier member having a sector gear means attached thereto for removably engaging said ring gear, (c) switch member means for activating said carrier member in order to selectively operate in said first and second positions and (d) ramp means within said housing configured for coaction with said carrier member to axially displace said carrier member on pivotal movement thereof in response to actuation of said switch member means, said switch member means being disposed above said handle portion for actuation by the thumb of an operator in order to enable one hand operation of said hair twining apparatus.

2. The hair twining apparatus of claim 1 wherein said ratchet means includes a toothed portion of said pinion gear member interacting with a toothed portion of said drive gear member.

3. The hair twining apparatus of claim 2 wherein said apparatus further includes friction means coacting between said drive gear member and said sub-housing for assisting in restraining said drive gear member from reverse rotation during reverse travel of said trigger under force of its spring with said coupling means in said first position.

4. The hair twining apparatus of claim 3 wherein said friction means includes leaf spring members mounted within said sub-housing and having bent ends coacting with said drive gear member teeth.

* * * * *